US010816924B2

(12) United States Patent
Kikuchi

(10) Patent No.: US 10,816,924 B2
(45) Date of Patent: Oct. 27, 2020

(54) IMAGE FORMING APPARATUS CAPABLE OF SUPPRESSING OCCURRENCE OF DAMAGE TO IMAGE HOLDING BODY CAUSED BY CARRIER

(71) Applicant: FUJI XEROX CO.,LTD., Tokyo (JP)

(72) Inventor: Yuji Kikuchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/285,240

(22) Filed: Feb. 26, 2019

(65) Prior Publication Data

US 2020/0096911 A1 Mar. 26, 2020

(30) Foreign Application Priority Data

Sep. 21, 2018 (JP) ..... 2018-176972

(51) Int. Cl.
*G03G 15/00* (2006.01)

(52) U.S. Cl.
CPC ..... *G03G 15/5012* (2013.01)

(58) Field of Classification Search
CPC ..... G03G 15/5012; G03G 21/168
USPC ..... 399/18, 19, 21, 71, 99
See application file for complete search history.

(56) References Cited

U.S. PATENT DOCUMENTS 5,822,648 A * 10/1998 Mohri ..... G03G 15/161 399/46
5,943,524 A * 8/1999 Eom ..... G03G 15/1605 399/18
10,175,603 B2 1/2019 Matsumoto
10,338,502 B2 * 7/2019 Hirado ..... G03G 15/161
2005/0111860 A1 * 5/2005 Park ..... G03G 15/5012 399/18

FOREIGN PATENT DOCUMENTS

| | | | |
|---|---|---|---|
| JP | 02148076 A | * | 6/1990 |
| JP | 11109766 A | * | 4/1999 |
| JP | 2000081802 A | * | 3/2000 |
| JP | 2001183917 | | 7/2001 |
| JP | 2003215879 A | * | 7/2003 |
| JP | 2004012482 | | 1/2004 |
| JP | 2013156374 A | * | 8/2013 |
| JP | 2018018023 | | 2/2018 |
| JP | 2018060084 | | 4/2018 |

* cited by examiner

*Primary Examiner* — Robert B Beatty
(74) *Attorney, Agent, or Firm* — JCIPRNET

(57) ABSTRACT

An image forming apparatus includes an image holding body that rotates, an image forming unit, and a return operation controller. The image forming unit includes a charger, an exposure unit, a developing unit, a transfer unit, and a cleaning unit. The return operation controller causes a clean-up step to be executed in which the image holding body is cleaned while rotating the image holding body when returning from an emergency stop. In the clean-up step, the return operation controller reduces or zeroes out a pressing force between the transfer unit and the image holding body at least until a developing operation area on a surface of the image holding body that is stopped upon the emergency stop facing toward a direction in which the developing unit operates passes through a pressing area pressed by the transfer unit.

4 Claims, 10 Drawing Sheets

IMAGE FORMING APPARATUS CAPABLE OF SUPPRESSING OCCURRENCE OF DAMAGE TO IMAGE HOLDING BODY CAUSED BY CARRIER

CROSS-REFERENCE TO RELATED APPLICATIONS

This application is based on and claims priority under 35 USC 119 from Japanese Patent Application No. 2018-176972 filed Sep. 21, 2018.

BACKGROUND

(i) Technical Field

The present disclosure relates to an image forming apparatus.

(ii) Related Art

There is known a so-called electrophotographic image forming apparatus including an image holding body that rotates, and an image forming unit. The image forming units includes a charger, an exposure unit, a developing unit, a transfer unit, and a cleaning unit, and these units sequentially operate along a rotating direction of the image holding body. The developing unit develops, with toner, an electrostatic latent image formed by the exposure. The transfer unit transfers a toner image formed by the development. The cleaning unit cleans the image holding body.

In this image forming apparatus, for example, an emergency stop operation of the apparatus is executed when some kind of emergency situation occurs, such as when there is a paper jam or the door is carelessly opened. At the time of this emergency stop, a mechanical operation stop, such as a sudden stop of the image holding body, and a stop of power supply from the power source are done.

The developing unit generally includes a developing roller that carries a developer including toner and a carrier to a developing area that faces the image holding body as the developing roller rotates. The carrier is drawn to the developing roller by a magnetic force. In response to an emergency stop of the developing roller, the carrier may adhere to the image holding body due to an impact at that time.

After the emergency stop, when the cause of the emergency stop is removed, a return operation is performed next. In this return operation, a clean-up operation is executed in which the image holding body is rotated and the developer adhering to the image holding body is cleaned by the cleaning unit.

Here, the transfer unit includes a transfer member such as a transfer roller. The image holding body is pressed by the transfer member, and a transfer-receiving body such as an intermediate transfer body or paper is held between the image holding body and the transfer member to transfer a toner image on the image holding body to the transfer-receiving body while pressing the transfer-receiving body against the image holding body. Therefore, when the carrier adheres to the image holding body at the time of an emergency stop, the carrier on the image holding body is pressed against the image holding body in a return operation. In recent years, the transfer member tends to be pressed intensely against the image holding body for suppressing vibrations in order to form a high-quality image. Therefore, the transfer member presses the carrier on the image holding body intensely against the image holding body in a return operation, which may hurt the image holding body.

Here, Japanese Unexamined Patent Application Publication No. 2001-183917 discloses the following: in the case of stopping driving of a photoconductor drum and an intermediate transfer body, the intermediate transfer body is separated from the photoconductor drum; and, in the case of restarting driving of the photoconductor drum and the intermediate transfer body, the intermediate transfer body is brought into contact again with the photoconductor drum.

In addition, Japanese Unexamined Patent Application Publication No. 2004-012482 discloses the following: in response to an emergency stop due to the occurrence of an emergency such as a paper jam, an intermediate transfer body is rotated for a certain period of time since the instance of the occurrence of the emergency.

SUMMARY

Aspects of non-limiting embodiments of the present disclosure relate to providing an image forming apparatus that suppresses the occurrence of damage to an image holding body caused by a carrier adhering to the image holding body in a return operation after an emergency stop.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image holding body that rotates, an image forming unit, and a return operation controller. The image forming unit includes a charger, an exposure unit, a developing unit, a transfer unit, and a cleaning unit, and these units sequentially operate along a rotating direction of the image holding body. The charger charges the image holding body with electricity. The exposure unit exposes the image holding body to light to form an electrostatic latent image. The developing unit includes a developing roller that feeds, while rotating, a developer including toner and a carrier to a developing area that faces the image holding body. The developing unit develops the electrostatic latent image with the toner and causes the image holding body to hold a toner image. The transfer unit transfers, while pressing a transfer-receiving body against the image holding body, the toner image on the image holding body to the transfer-receiving body. The cleaning unit cleans the image holding body. The return operation controller causes a clean-up step to be executed in which the image holding body is cleaned while rotating the image holding body when returning from an emergency stop. In the clean-up step, the return operation controller reduces or zeroes out a pressing force between the transfer unit and the image holding body at least until a developing operation area on a surface of the image holding body that is stopped upon the emergency stop facing toward a direction in which the developing unit operates passes through a pressing area pressed by the transfer unit.

BRIEF DESCRIPTION OF THE DRAWINGS

Exemplary embodiments of the present disclosure will be described in detail based on the following figures, wherein.

DETAILED DESCRIPTION

Hereinafter, exemplary embodiments of the present disclosure will be described with reference to the drawings.

Figure 1:
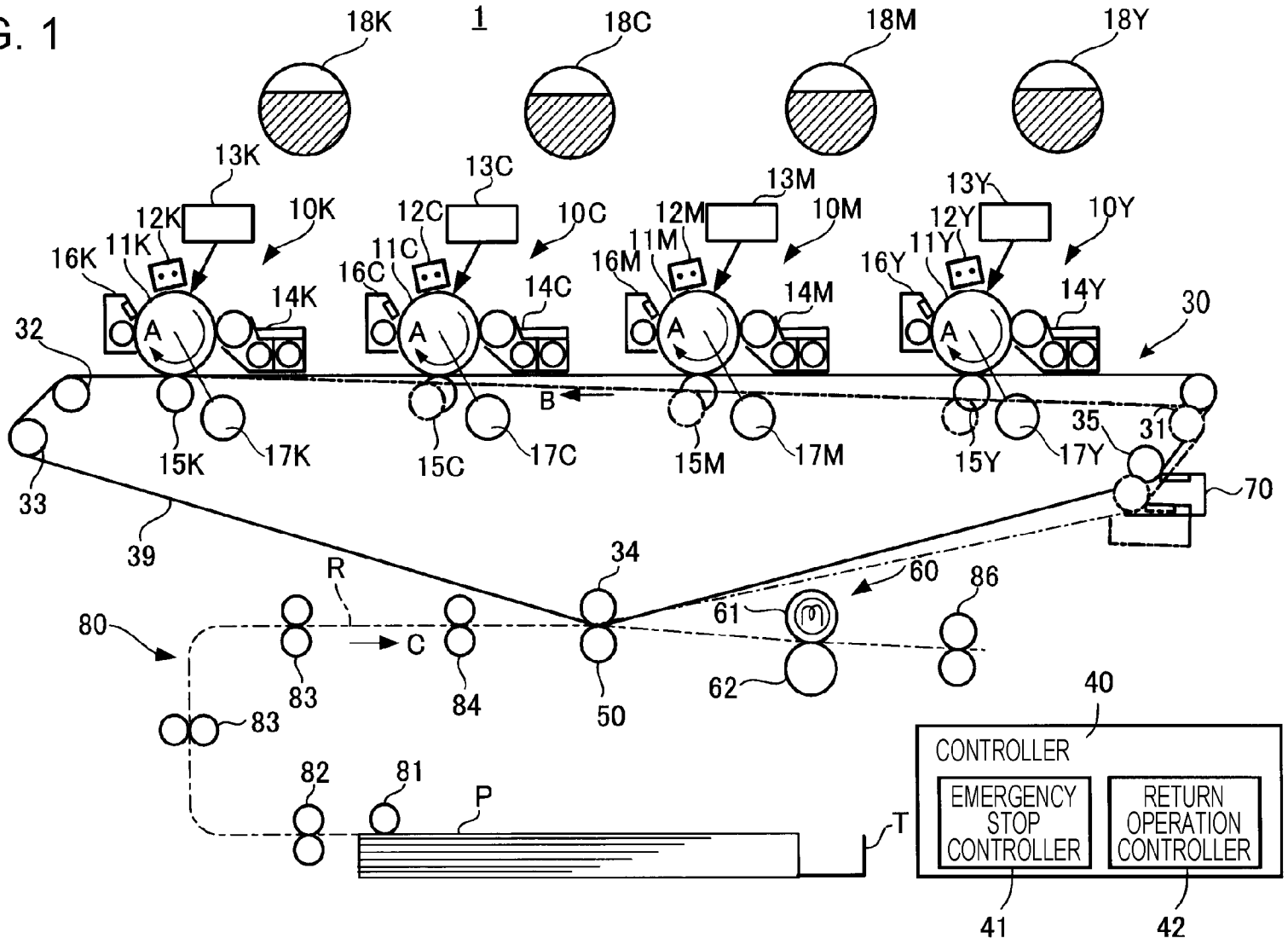
FIG. 1 is a configuration diagram illustrating an exemplary embodiment of an image forming apparatus according to the present disclosure.

FIG. 1 is a configuration diagram illustrating an exemplary embodiment of an image forming apparatus according to the present disclosure.

An image forming apparatus 1 illustrated in FIG. 1 is a tandem-type color printer in which image forming units 10Y, 10M, 10C, and 10K for yellow (Y), magenta (M), cyan (C), and black (K) are arranged in parallel. The image forming apparatus 1 is capable of printing a single-color image as well as a full-color image composed of four color toner images.

The image forming apparatus 1 includes toner cartridges 18Y, 18M, 18C, and 18K containing Y, M, C, and K color toners, respectively.

Because the four image forming units 10Y, 10M, 10C, and 10K have the same configuration except for the toner that is used, the suffixes (Y, M, C, and K) representing the colors are omitted below in describing the four image forming units 10Y, 10M, 10C, and 10K when making no distinctions among them.

The image forming unit 10 includes an image holding body 11, a charger 12, an exposure unit 13, a developing unit 14, a first transfer unit 15, and an image holding body cleaner 16. Here, the image holding body 11 corresponds to an example of an image holding body according to the present disclosure, and a combination of the charger 12, the exposure unit 13, the developing unit 14, the first transfer unit 15, and the image holding body cleaner 16 corresponds to an example of an image forming unit according to the present disclosure.

The image holding body 11 has a cylindrical shape, is driven by a pulse motor 17, and rotates in an arrow A direction which is around the axis of the cylinder while holding an image formed on the surface. The charger 12, the exposure unit 13, the developing unit 14, the first transfer unit 15, and the image holding body cleaner 16 are sequentially arranged around the image holding body 11.

The charger 12 charges the surface of the image holding body 11 with electricity. The charger 12 according to the present exemplary embodiment is a scorotron charger that is arranged without contacting the image holding body 11 and charges the image holding body 11 with electricity using corona discharge. Note that a charging roller that charges the image holding body 11 with electricity while being in contact with the surface of the image holding body 11 may be adopted as the charger 12.

The exposure unit 13 forms an electrostatic latent image on the surface of the image holding body 11 by scanning the image holding body 11 with laser light 131 (see FIG. 2) modulated on the basis of an image signal supplied from the outside of the image forming apparatus 1. Besides a laser light scanning system, a light-emitting diode (LED) array in which many LEDs are arranged along the scanning direction may be adopted as the exposure unit 13. Furthermore, a system in which a latent image is directly formed by many electrodes arranged along the scanning direction may be adopted as a latent image forming unit.

The developing unit 14 develops an electrostatic latent image on the surface of the image holding body 11 using a two-component developer including toner and a magnetic carrier.

Toner is supplied from the toner cartridge 18 to the developing unit 14, and the supplied toner is mixed with a carrier in the developing unit 14. The developing unit 14 charges the toner and the carrier with electricity by stirring the developer which is a mixture of the carrier and the toner. The charged developer is carried by a developing roller 141 (see FIG. 2) to an area facing the image holding body 11, and the electrostatic latent image on the surface of the image holding body 11 is developed by the toner in the developer.

The first transfer unit 15 is at a position facing the image holding body 11 with an intermediate transfer belt 39, which is included in an intermediate transfer unit 30, interposed therebetween, and is a roller that presses the intermediate transfer belt 39 against the image holding body 11. The first transfer unit 15 has a conductive elastic layer on its surface. In response to application of a transfer bias, a toner image on the image holding body 11 is electrostatically attracted to the intermediate transfer belt 39.

Figure 2:
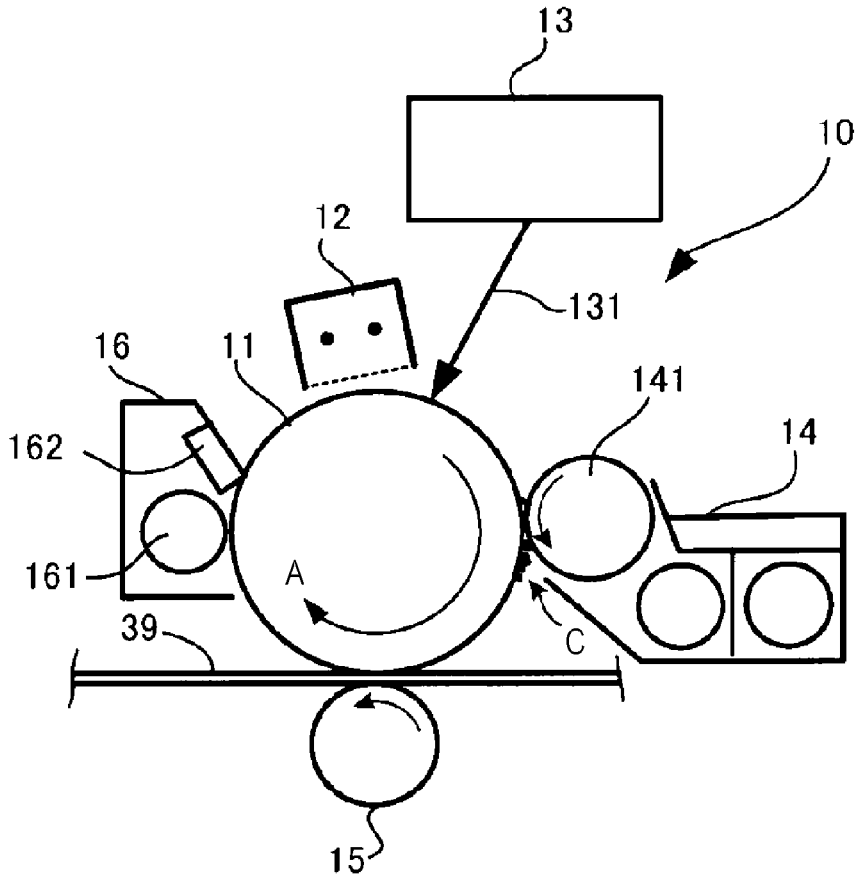
FIG. 2 is a diagram illustrating one of four image forming units included in the image forming apparatus illustrated in FIG. 1.

The image holding body cleaner 16 includes a cleaning brush 161 and a cleaning blade 162, as illustrated in FIG. 2. The image holding body 11 is cleaned by weakening, with the use of the cleaning brush 161, the adhesion of the toner to the surface of the image holding body 11, which remains on the surface of the image holding body 11 after the transfer, and then scraping off the residual toner with the use of the cleaning blade 162.

The intermediate transfer unit 30 is provided below the four image forming units 10Y, 10M, 10C, and 10K. The intermediate transfer unit 30 includes a plurality of belt supporting rollers 31 to 35, and the intermediate transfer belt 39, which is an endless belt bridged over the belt supporting rollers 31 to 35.

Here, the intermediate transfer unit 30 changes its position between a contact position and a separated position. In the contact position, which is illustrated by a solid line in FIG. 1, the intermediate transfer belt 39 contacts all the four image holding bodies 11Y, 11M, 11C, and 11K. In the separated position, which is illustrated by a dash-dotted line in FIG. 1, the intermediate transfer belt 39 is in contact with only one image holding body 11K, out of the four image holding bodies 11Y, 11M, 11C, and 11K, and is separated from the other three image holding bodies 11Y, 11M, and 11C. The first transfer units 15Y, 15M, 15C, and 15K are also members included in the intermediate transfer unit 30. In the separated position, among the four first transfer units 15Y, 15M, 15C, and 15K, the three first transfer units 15Y, 15M, and 15C except for the remaining one first transfer unit 15K are evacuated to positions at which the intermediate transfer belt 39 is not pressed against the image holding bodies 11Y, 11M, and 11C, as illustrated by the dash-dotted line in FIG. 1.

In the image forming apparatus 1, the intermediate transfer unit 30 is positioned in the contact position when forming a color image, and is positioned in the separated position when forming a monochrome image. Because a toner image is formed only by the image forming unit 10K which uses black (K) in the case of forming a monochrome image, the intermediate transfer unit 30 takes the separated position.

The following description assumes the case of forming a color image.

To form a color image, the intermediate transfer belt 39 circulates and moves over the four image forming units 10Y, 10M, 10C, and 10K and a second transfer unit 50 in a direction indicated by an arrow B. Toner images of the individual colors are transferred from the four image holding bodies 11Y, 11M, 11C, and 11K to the intermediate transfer belt 39. The intermediate transfer belt 39 holds these toner images of the individual colors and moves.

The second transfer unit 50 is a roller that rotates while holding the intermediate transfer belt 39 and paper with a backup roller 34, which is one of the belt supporting rollers 31 to 35. The second transfer unit 50 has a conductive elastic layer on its surface. In response to application of a voltage, the toner images on the intermediate transfer belt 39 are electrostatically attracted to the paper.

A belt cleaner 70 cleans toner and paper powder on the intermediate transfer belt 39.

A fixing unit 60 fixes toner images on paper. The fixing unit 60 includes a heating roller 61 and a pressure roller 62. The heating roller 61 includes a heater. The heating roller 61 and the pressure roller 62 pass paper on which toner images before being fixed are formed while holding the paper in between them, thereby heating the toner images and applying pressure to the toner images to fix the toner images on the paper.

A paper feed unit 80 includes the following: a take-out roller 81, which takes out paper P accommodated in a paper tray T; separating rollers 82, which separate the taken-out paper; feed rollers 83, which feed the paper; registration rollers 84, which feed the paper to the second transfer unit 50; and discharge rollers 86, which discharge the paper to the outside. The paper feed unit 80 feeds paper along a paper feed path R which is via the second transfer unit 50 and the fixing unit 60.

In addition, the image forming apparatus 1 includes a controller 40. The controller 40 is, in terms of hardware, one type of information processing device including an arithmetic element such as a central processing unit (CPU) and a storage element such as a read-only memory (ROM) and a random-access memory (RAM). The controller 40 controls each unit of the image forming apparatus 1 by incorporating and executing various programs describing the control details of each unit of the image forming apparatus 1.

In addition, the controller 40 includes an emergency stop controller 41 and a return operation controller 42, which serve as elements realizing characteristic operations of the present exemplary embodiment. These elements will be described in detail later.

The basic operation of the image forming apparatus 1 illustrated in FIG. 1 will be described. The image forming unit 10Y for yellow will be described by way of example. In this image forming unit 10Y for yellow, the image holding body 11Y is rotatably driven in the arrow A direction, and electric charge is applied by the charger 12Y to the surface of the image holding body 11Y. The exposure unit 13Y emits exposure light, which is modulated on the basis of an image signal corresponding to yellow out of an image signal supplied from the outside, to the surface of the image holding body 11Y, thereby forming an electrostatic latent image on the surface of the image holding body 11Y. The developing unit 14Y forms a toner image by developing the electrostatic latent image with toner in a developer. Yellow toner is constantly supplied from the toner cartridge 18Y to the developing unit 14Y. The image holding body 11Y rotates while holding the yellow toner image formed on its surface. The toner image formed on the surface of the image holding body 11Y is transferred by the first transfer unit 15Y to the intermediate transfer belt 39. After the transfer, the toner remaining on the image holding body 11Y is collected and removed by the image holding body cleaner 16Y.

The image forming units 10M, 10C, and 10K corresponding to colors other than yellow form toner images of colors corresponding to the respective image forming units, like the image forming unit 10Y for yellow, and transfer the toner images of the respective colors to the intermediate transfer belt 39 over the toner image transferred by the image forming unit 10Y for yellow.

Paper P is taken out from the paper tray T by the take-out roller 81. The paper P is fed by the feed rollers 83 and the registration rollers 84 on the paper feed path R in an arrow C direction toward the second transfer unit 50. The registration rollers 84 feed the paper P to the second transfer unit 50 such that the toner images on the intermediate transfer belt 39 and the paper P arrive at the second transfer unit 50 at the same time, and the second transfer unit 50 transfers the toner images on the intermediate transfer belt 39 to the paper P. The paper P on which the toner images are transferred is fed from the second transfer unit 50 to the fixing unit 60, and the toner images transferred on the paper P are fixed. In this manner, an image is formed on the paper P. The paper P on which the image is formed is discharged by the discharge rollers 86 to the outside of the image forming apparatus 1. The toner remaining on the intermediate transfer belt 39, after the transfer by the second transfer unit 50, is removed from the intermediate transfer belt 39 by the belt cleaner 70.

In this image forming apparatus 1, in response to detection of the occurrence of emergency where it is difficult to continue image formation, the image forming apparatus 1 is brought to an emergency stop even in the middle of the image formation. The term "emergency" here refers to, for example, the occurrence of a so-called jam where paper P being fed is jammed halfway, or that a door (not illustrated) is carelessly opened. If a jam occurs, the normal image forming operation thereafter becomes impossible. If a jam occurs while the paper P is in contact with the fixing unit 60, this may cause ignition. In addition, the image forming apparatus 1 includes various movable members, and, if the door is carelessly opened, the user may contact these movable members and may be hurt unexpectedly. Therefore, when such emergency as above occurs, the movable members are brought to an emergency stop, and power supply to high-voltage and high-temperature components is urgently cut off.

After the emergency stop, when the cause of the emergency stop is removed, a return operation is executed. In this return operation, a clean-up operation is executed in which the image holding body 11 and the intermediate transfer belt 39 are driven, and toner on the image holding body 11 or the intermediate transfer belt 39 is removed by the image holding body cleaner 16 or the belt cleaner 70.

FIG. 2 is a diagram illustrating one of four image forming units included in the image forming apparatus illustrated in FIG. 1. Referring now to FIG. 2, problems that may occur when measures according to the present exemplary embodiment are not taken will be described. Therefore, FIG. 2 corresponds to a comparative example of the present disclosure.

As described above, in this image forming apparatus 1, the developing unit 14 accommodates a two-component developer including toner and a carrier, and the developer is carried by the developing roller 141 to a developing position facing the image holding body 11. An electrostatic latent image formed on the image holding body 11 is developed with the toner in the developer. The carrier passes the developing position as it is and is collected into the developing unit 14.

If the above-described emergency occurs, all the movable members such as the image holding body 11 and the intermediate transfer belt 39 stop at the same time under control of the emergency stop controller 41 illustrated in FIG. 1. Then, an impact caused by a sudden change in the movement may cause a phenomenon in which not only the toner in the developer but also a carrier C flies to the image holding body 11 and adheres to the surface of the image holding body 11. Even when all the movable members stop at the same time, there is inertia in the movement of the members. The carrier C that has flown to the image holding body 11 does not stay only in the area of the image holding body 11 that faces the developing roller 141, but is spread to an area moved toward the first transfer unit 15 due to rotation of the image holding body 11 caused by inertia until the image holding body 11 stops.

Thereafter, when the cause of the emergency is removed, a return operation is performed next under control of the return operation controller 42. In this return operation, a clean-up operation is executed first. In this clean-up operation, the image holding body 11 and the intermediate transfer belt 39 are operated without applying a transfer bias to the first transfer unit 15. Then, the developer including the carrier C which adheres to the image holding body 11 reaches the image holding body cleaner 16 without being transferred by the first transfer unit 15, and is removed from the image holding body 11 by the image holding body cleaner 16. Accordingly, the image holding body 11 is cleaned, and the image forming apparatus 1 is now prepared to perform the next image forming operation. Likewise, the toner remaining on the intermediate transfer belt 39 at the time of the emergency stop is removed from the intermediate transfer belt 39 by the belt cleaner 70.

Here, in the case of the image forming apparatus 1 illustrated in FIG. 1, due to an evacuation operation of the intermediate transfer unit 30, the intermediate transfer belt 39 may be separated from the image holding bodies 11Y, 11M, and 11C except for the image holding body 11K for black (K). At the time of an emergency stop, there is no time to evacuate the intermediate transfer unit 30. In the case where a color image is being formed before an emergency stop, the operation stops while the first transfer unit 15 presses the intermediate transfer belt 39 against the image holding body 11. Therefore, in the clean-up process in the return operation, the developer including the carrier C, which adheres to the image holding body 11, passes between the image holding body 11 and the intermediate transfer belt 39, which is pressed by the first transfer unit 15, and reaches the image holding body cleaner 16. The carrier C contains hard grains that are larger than the toner. While passing between the image holding body 11 and the intermediate transfer belt 39, these hard and large grains are pressed against the image holding body 11, which may in turn hurt the image holding body 11. Especially in recent years, vibrations are not welcome from the viewpoint of increasing the image quality, and the intermediate transfer belt 39 tends to be intensely pressed against the image holding body 11. Therefore, the image holding body 11 is greatly hurt due to the pressing of the carrier C, and defects caused by the damage to the image holding body 11 appear on the formed image. This condition is becoming a situation that may not be overlooked.

On the basis of the above description with reference to FIG. 2, various exemplary embodiments of the present disclosure will be described hereinafter.

Figure 3:
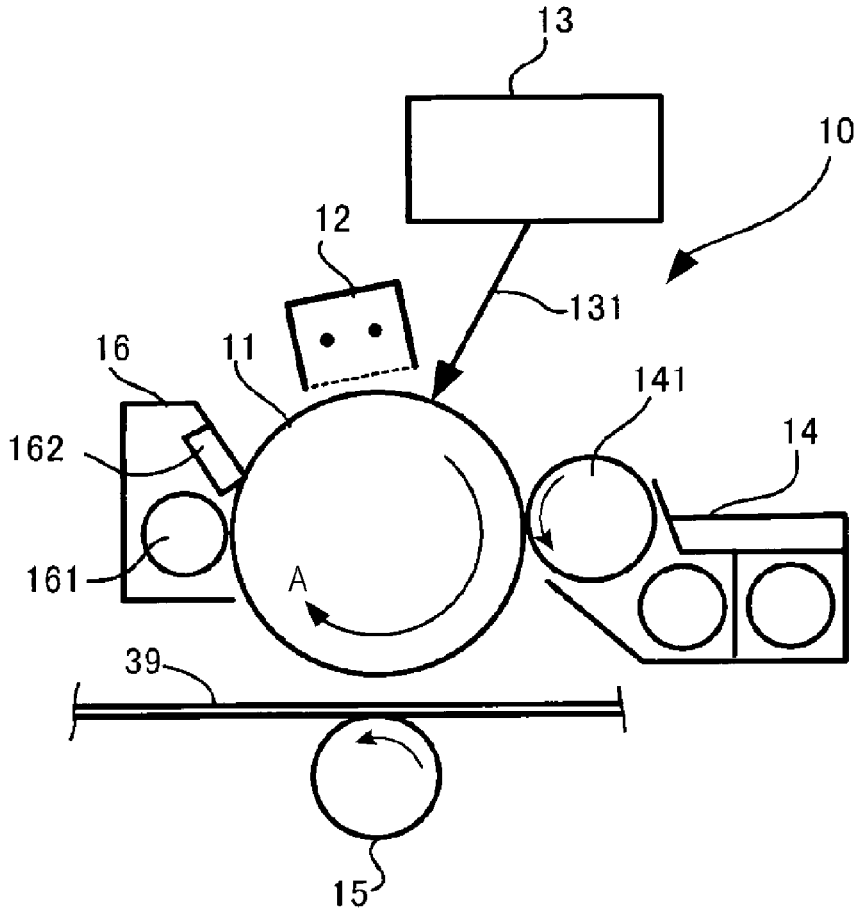
FIG. 3 is a diagram illustrating one image forming unit in a first exemplary embodiment of the present disclosure.

FIG. 3 is a diagram illustrating one image forming unit in a first exemplary embodiment of the present disclosure.

Figure 4A:
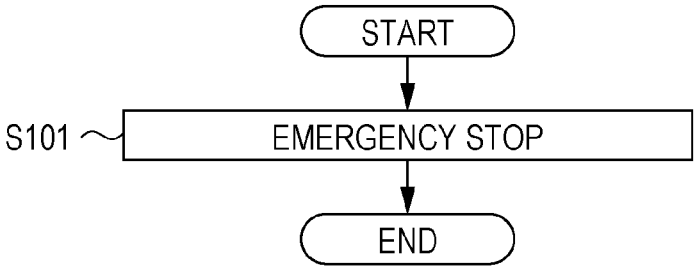
FIG. 4A is a flowchart illustrating emergency stop control performed by an emergency stop controller in the first exemplary embodiment.
Figure 4B:
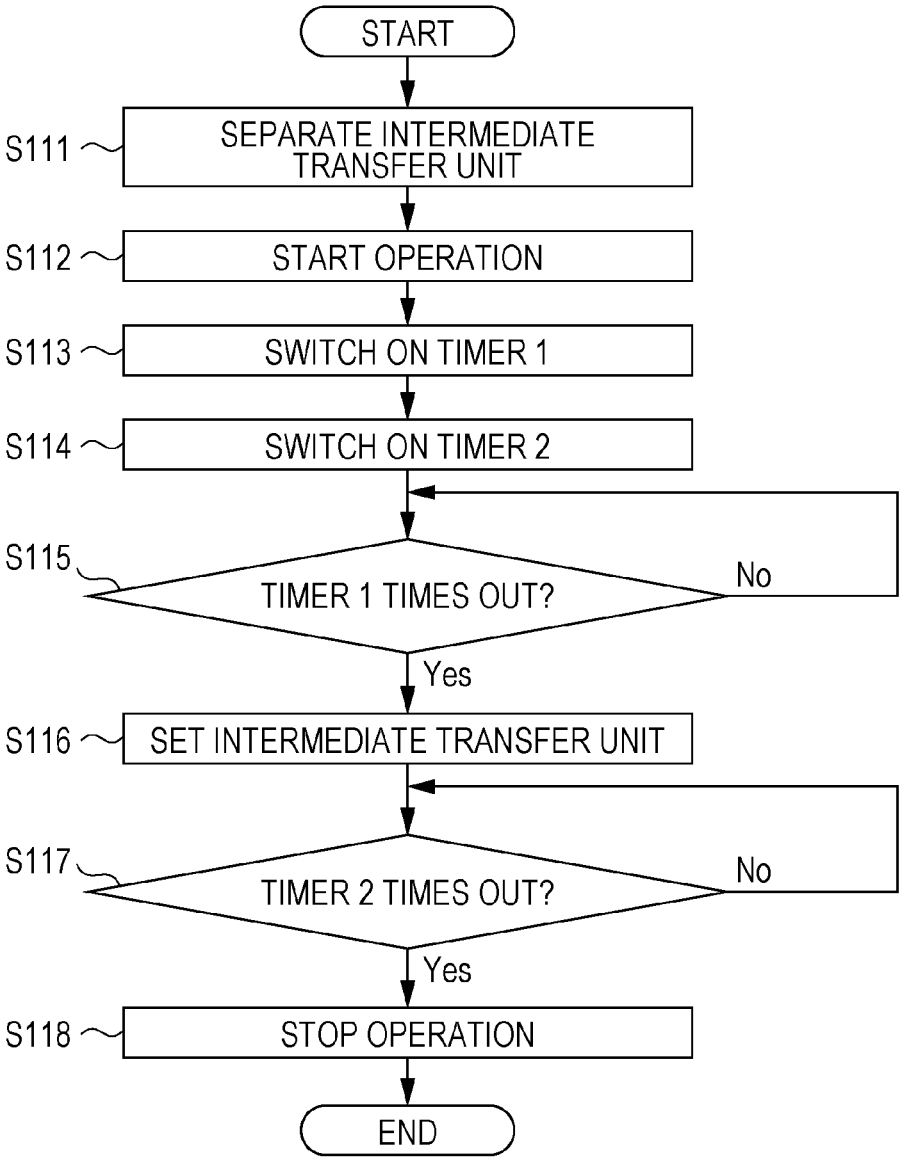
FIG. 4B is a flowchart illustrating return operation control performed by a return operation controller in the first exemplary embodiment.

FIG. 4A is a flowchart illustrating emergency stop control performed by the emergency stop controller in the first exemplary embodiment. FIG. 4B is a flowchart illustrating return operation control performed by the return operation controller in the first exemplary embodiment.

FIG. 3 is different from FIG. 2 in the point that the intermediate transfer belt 39 is separated from the image holding body 11.

When an emergency occurs, an emergency stop is done under control of the emergency stop controller 41 (step S101 in FIG. 4A). In the case of the first exemplary embodiment, an emergency stop is not different from that of the related art.

After the emergency stop, when the cause of the emergency stop is removed, a return operation is executed next under control of the return operation controller 42 (FIG. 4B).

Here, separation operation of the intermediate transfer unit 30 (movement to the separated position indicated by the dash-dotted line in FIG. 1) is performed before the start of operation, which is that the operation of members such as the image holding body 11 and the intermediate transfer belt 39 is started (step S111). Note that, in the case where a monochrome image is being formed immediately before the emergency stop, that is, when the intermediate transfer unit 30 is already in the separated position, step S111 is skipped. The operation is started (step S112), and a timer 1 and a timer 2 are switched on (steps S113 and S114). The timer 1 is a timer for measuring time until the carrier C (see FIG. 2) adhering to the image holding body 11 due to the emergency stop passes through a pressing area where the intermediate transfer belt 39 presses the image holding body 11. The timer 2 is a timer for measuring time until the surface of the image holding body 11 is sufficiently cleaned.

When the operation is started and the timer 1 times out (step S115), "set the intermediate transfer unit" is executed. This "set the intermediate transfer unit" step is a step for moving the intermediate transfer unit 30 to the contact position indicated by the solid line in FIG. 1, that is, bringing the intermediate transfer belt 39 into contact with the image holding body 11 and causing the first transfer unit 15 to press the intermediate transfer belt 39 against the image holding body 11. Note that, in the case where the intermediate transfer unit 30 is already in the separated position before the emergency stop and formation of a monochrome image is continued after the return operation ends, step S116 is skipped.

Thereafter, a clean-up step in which the image holding body 11 is cleaned by the image holding body cleaner 16 while rotating the image holding body 11 is continued, and, when the timer 2 times out (step S117), the operation in the clean-up step is stopped (step S118). Whether or not to immediately proceed to image formation thereafter is different depending on, for example, the state immediately before the emergency stop, or whether or not a reset button is pressed during the emergency stop.

In this manner, in the case of the first exemplary embodiment, the intermediate transfer belt 39 is separated from the image holding body 11 until a developing operation area on the surface of the image holding body 11 that is stopped upon the emergency stop facing toward a direction in which the developing roller 141 operates passes through a pressing area pressed by the first transfer unit 15, thereby releasing the image holding body 11 from being pressed by the first transfer unit 15. Accordingly, the occurrence of damage to the image holding body 11, caused by pressing the carrier C against the image holding body 11, is suppressed.

Here, the developing operation area includes not only an area where the developer from the developing unit 14 adheres to the image holding body 11 due to an electrical impact at the time of the emergency stop, but also includes an area where the developer from the developing unit 14 adheres to the image holding body 11 due to a mechanical impact at the time of the emergency stop.

Note that the description here is based on the assumption of the image forming apparatus 1 illustrated in FIG. 1, and therefore those to which the first exemplary embodiment is applied are the three image forming units 10Y, 10M, and 10C; the first exemplary embodiment is not applied to the image forming unit 10K in which the intermediate transfer belt 39 remains in contact with the image forming unit 10K. Even in the case of the image forming apparatus 1 illustrated in FIG. 1, the occurrence of damage to some of the image holding bodies 11Y, 11M, and 11C caused by the carrier C may be suppressed. Furthermore, in the case where a configuration in which the intermediate transfer belt 39 is separated from all the image holding bodies 11Y, 11M, 11C, and 11K is adopted, the occurrence of damage to all the image holding bodies 11Y, 11M, 11C, and 11K caused by the carrier C is suppressed by applying the first exemplary embodiment.

Here, although the pressing force in the pressing area is made zero by separating the intermediate transfer belt 39 from the image holding body 11, it is not always necessary to separate the intermediate transfer belt 39 from the image holding body 11. The occurrence of damage to the image holding body 11 caused by the carrier C may be suppressed by reducing the pressing force of the first transfer unit 15 while having the intermediate transfer belt 39 in contact with the image holding body 11.

Figure 5:
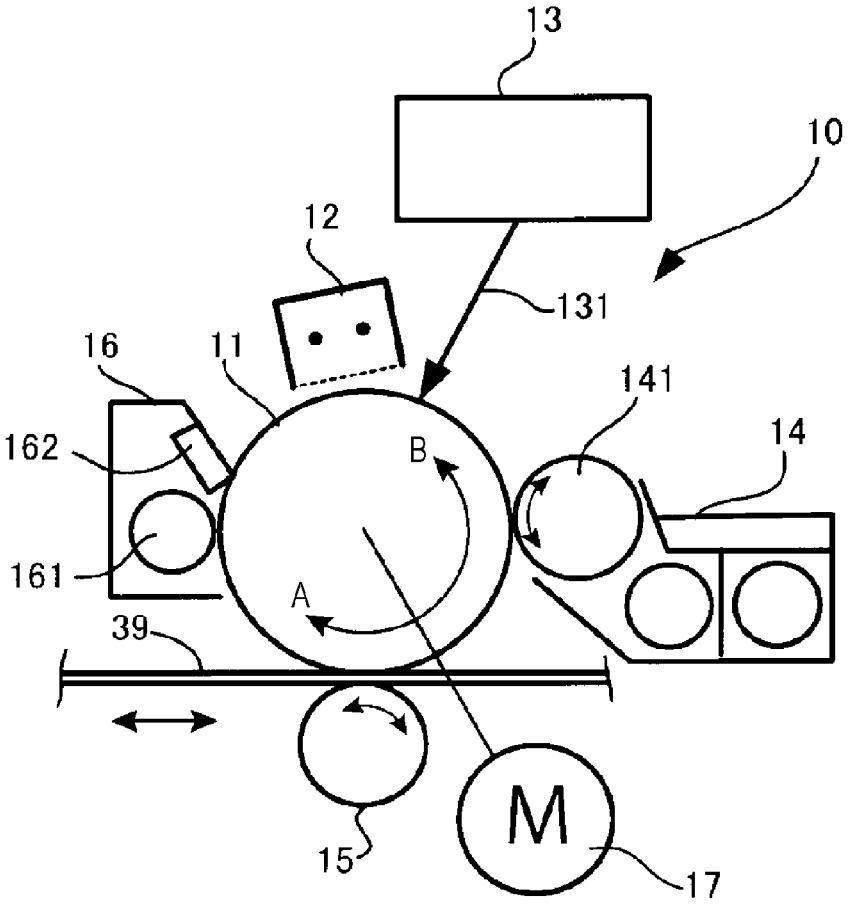
FIG. 5 is a diagram illustrating one image forming unit in a second exemplary embodiment of the present disclosure.

FIG. 5 is a diagram illustrating one image forming unit in a second exemplary embodiment of the present disclosure.

Figure 6A:
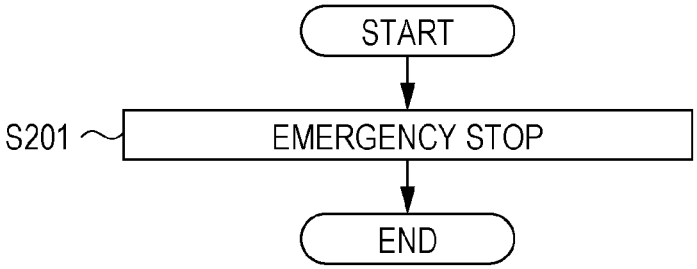
FIG. 6A is a flowchart illustrating emergency stop control performed by the emergency stop controller in the second exemplary embodiment.
Figure 6B:
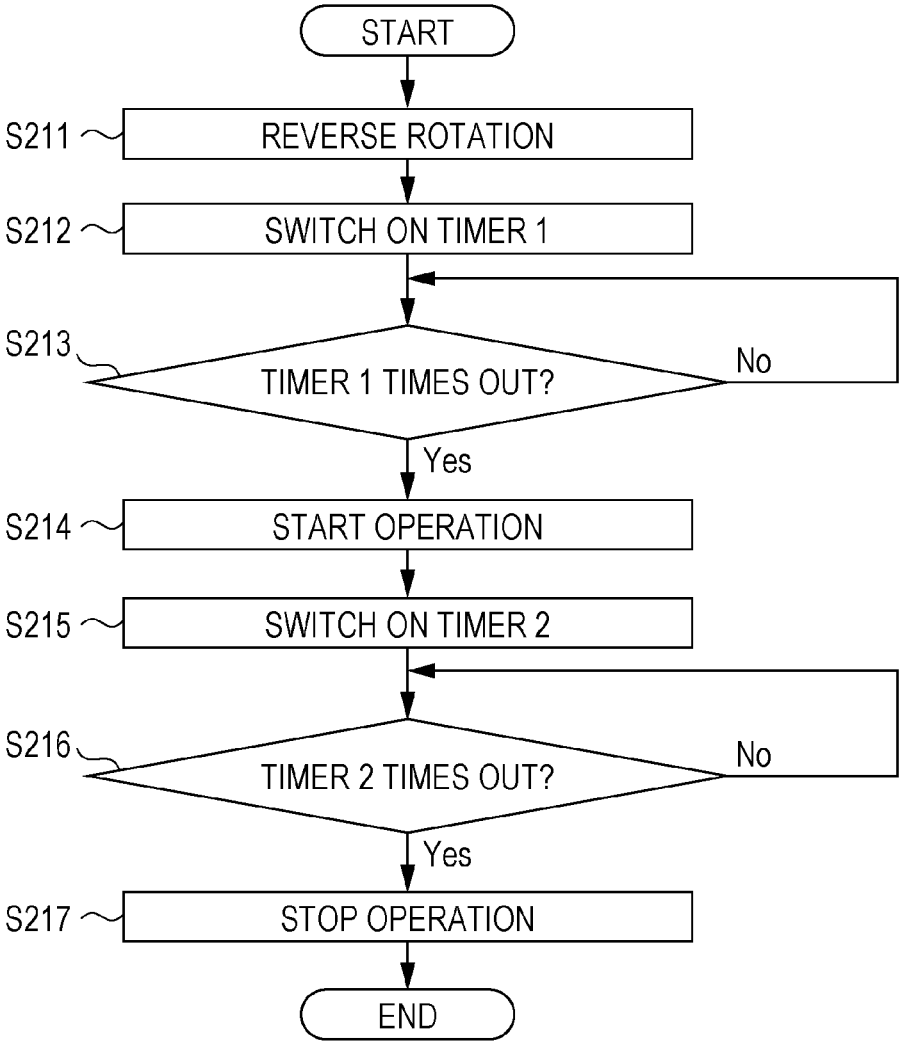
FIG. 6B is a flowchart illustrating return operation control performed by the return operation controller in the second exemplary embodiment.

FIG. 6A is a flowchart illustrating emergency stop control performed by the emergency stop controller in the second exemplary embodiment. FIG. 6B is a flowchart illustrating return operation control performed by the return operation controller in the second exemplary embodiment.

The image forming unit 10 illustrated in FIG. 5 is different from that in FIG. 2 in the point that there is provided the motor 17 which not only forward-rotates the image holding body 11 in an arrow A direction but also reverse-rotates the image holding body 11 in an arrow B direction. Accordingly, the first transfer unit 15 and the developing roller 141 are additionally reverse-rotated when the image holding body 11 is reverse-rotated, and additionally the intermediate transfer belt 39 moves in a reverse direction.

When an emergency occurs, an emergency stop is done under control of the emergency stop controller 41 (step S201 in FIG. 6A). In the case of the second exemplary embodiment, like the case of the first exemplary embodiment, the emergency stop is not different from that of the related art.

After the emergency stop, when the cause of the emergency stop is removed, a return operation is executed next under control of the return operation controller 42 (FIG. 6B).

Here, at first, the image holding body 11 and so forth are reverse-rotated (step S211), and the timer 1 is switched on (step S212). The timer 1 is a timer for measuring time until an area on the surface of the image holding body 11 in which the carrier C adheres to the image holding body 11 due to the emergency stop passes through a position facing the developing roller 141 in a reversed direction. When the image holding body 11 is reverse-rotated, the carrier C adhering to the surface of the image holding body 11 passes through an area facing the developing roller 141, and the carrier C is collected to the developing roller 141 due to the magnetic force of the developing roller 141. Regarding the reverse rotation of the image holding body 11, the image holding body 11 is rotated at a speed slower than that in the forward rotation. Due to the reverse rotation at a slow rotation speed, the carrier C on the image holding body 11 is further collected to the developing roller 141, compared with the case of reverse rotation at the same rotation speed as that of the forward rotation.

When the timer 1 times out (step S213), the operation is started by forward rotation (step S215), and the timer 2 is switched on (step S215). Even if the carrier C is collected to the developing roller 141 by the reverse rotation, the toner remains on the surface of the image holding body 11. The timer 2 is a timer for measuring time until the remaining toner is removed and the surface of the image holding body 11 is sufficiently cleaned.

When the timer 2 times out (step S216), the operation in the clean-up step is stopped (step S217).

Figure 7:
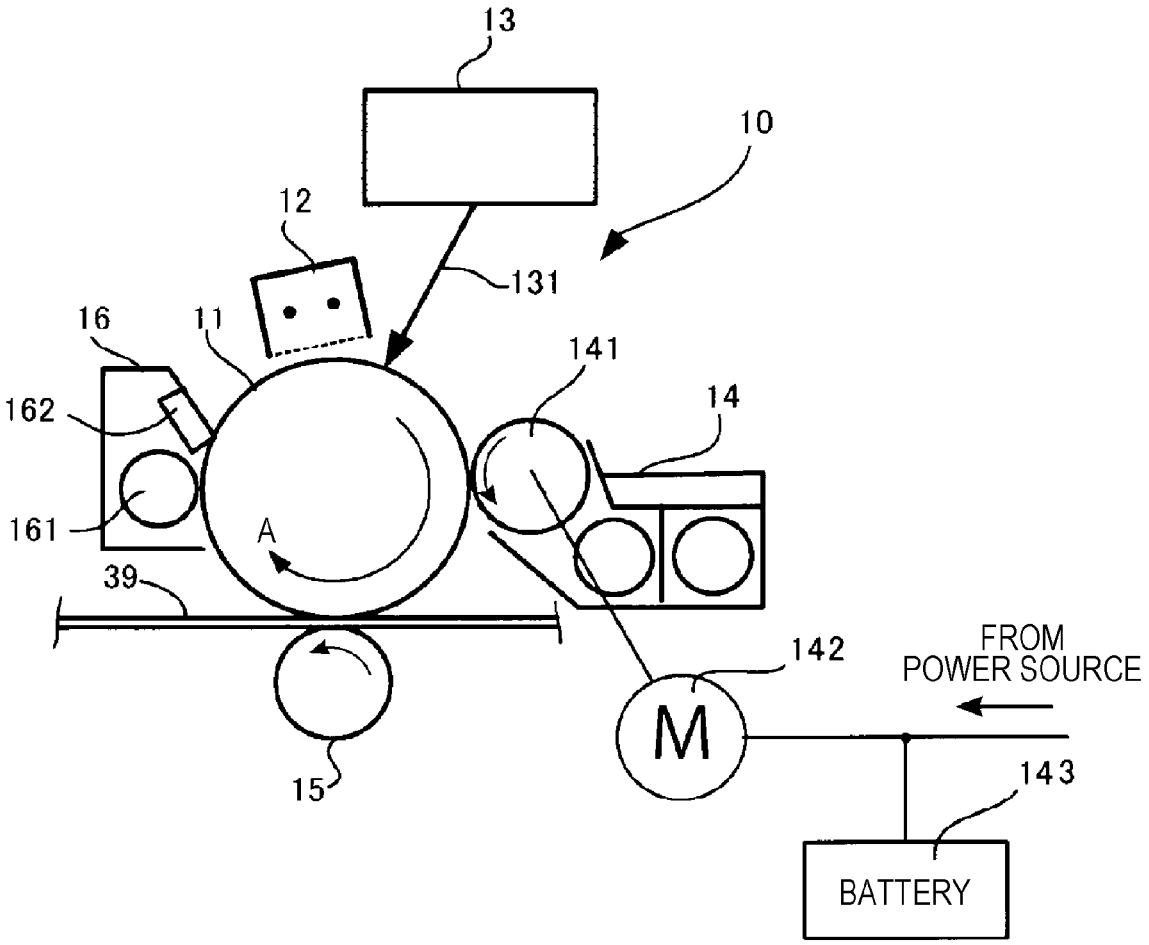
FIG. 7 is a diagram illustrating one image forming unit in a third exemplary embodiment of the present disclosure.

FIG. 7 is a diagram illustrating one image forming unit in a third exemplary embodiment of the present disclosure.

Figure 8A:
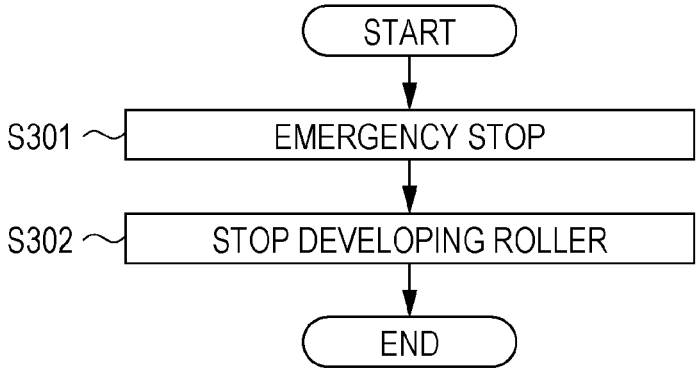
FIG. 8A is a flowchart illustrating emergency stop control performed by the emergency stop controller in the third exemplary embodiment.
Figure 8B:
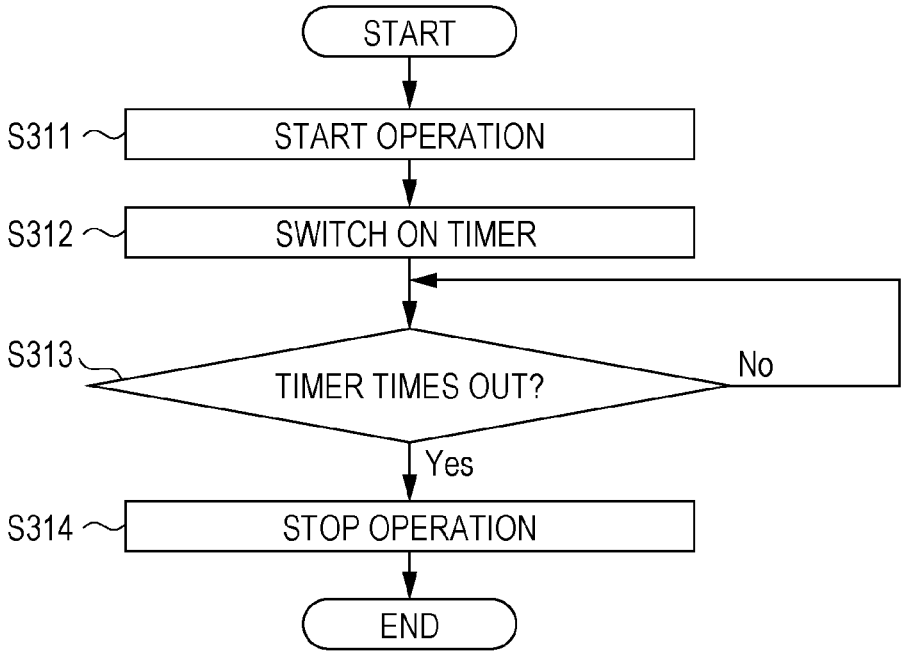
FIG. 8B is a flowchart illustrating return operation control performed by the return operation controller in the third exemplary embodiment.

FIG. 8A is a flowchart illustrating emergency stop control performed by the emergency stop controller in the third exemplary embodiment. FIG. 8B is a flowchart illustrating return operation control performed by the return operation controller in the third exemplary embodiment.

The image forming unit 10 illustrated in FIG. 7 is different from that in FIG. 2 in the point that there are provided a motor 142 that rotatably drives the developing roller 141, and a battery 143 arranged on a power supply path from a power source (not illustrated) to the motor 142. Although the motor 142 is illustrated that it rotatably drives the developing roller 141, the motor 142 may be one that drives the entire developing unit 14. In the case of the third exemplary embodiment, it is necessary that the structure be one that it is capable of rotatably driving the developing roller 141 even if the image holding body 11 stops. In the case of the third exemplary embodiment, there is provided the battery 143 connected to the motor 142. Even if the rotation of the image holding body 11 stops due to a stop of the power supply from the power source (not illustrated), because there is electric power from the battery 143 for the developing roller 141, the rotation of the developing roller 141 may be continued for a while.

The third exemplary embodiment is an exemplary embodiment characterized in emergency stop control (FIG. 8A) performed by the emergency stop controller.

When an emergency occurs, an emergency stop is done under control of the emergency stop controller 41 (step S301 in FIG. 8A). In this emergency stop, electric power supplied particularly to movable parts, high-voltage parts, and/or heating parts is stopped, except for some parts including the controller 40. Accordingly, the rotation of the image holding body 11 and the movement of the intermediate transfer belt 39 stop. As described above, the battery 143 is connected to the developing roller 141. Therefore, using the electric power of the battery 143, the developing roller 141 is stopped after the image holding body 11 and so forth are brought to an emergency stop (step S302). Here, the rotation of the developing roller 141 is slowly stopped at a stopping speed slower than the stopping speed at which the rotation of the image holding body 11 is stopped by the emergency stop. When the developing roller 141 is slowly stopped, an impact at the time of the stop weakens, and flying of the carrier C from the developing roller 141 to the image holding body 11 is suppressed.

After the emergency stop, when the cause of the emergency stop is removed, a return operation is executed next under control of the return operation controller 42 (FIG. 8B). In the case of the third exemplary embodiment, the return operation is the same as that of the related art. That is, here, the operation is started (step S311); a timer for measuring time until the operation is stopped is switched on (step S312); and, when the timer times out (step S313), the operation in the clean-up step is stopped (step S314).

Figure 9:
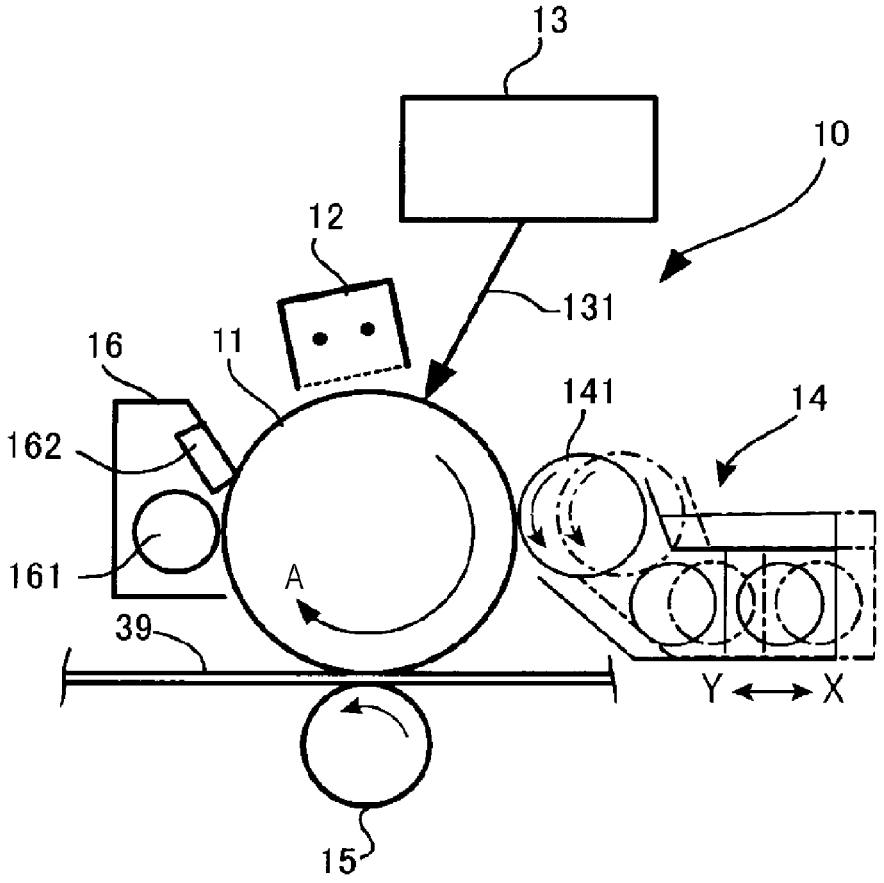
FIG. 9 is a diagram illustrating one image forming unit in a fourth exemplary embodiment of the present disclosure.

FIG. 9 is a diagram illustrating one image forming unit in a fourth exemplary embodiment of the present disclosure.

Figure 10A:
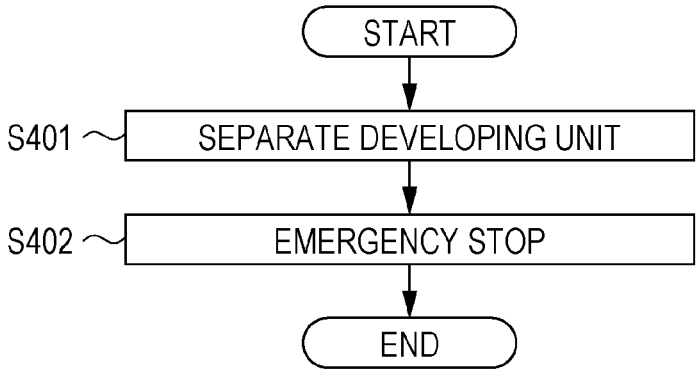
FIG. 10A is a flowchart illustrating emergency stop control performed by the emergency stop controller in the fourth exemplary embodiment.
Figure 10B:
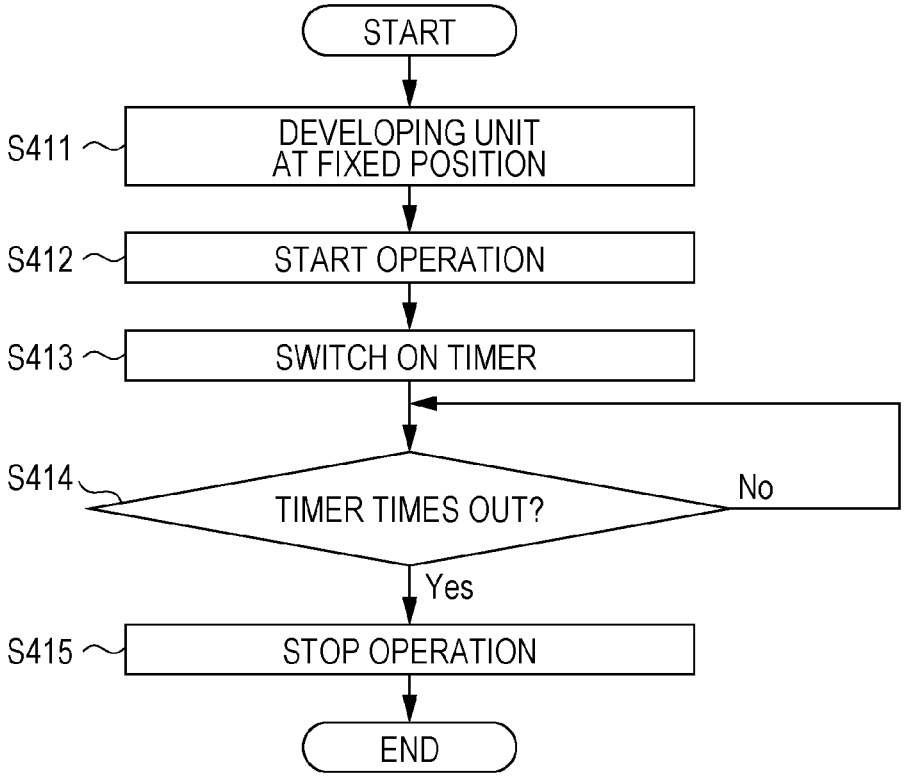
FIG. 10B is a flowchart illustrating return operation control performed by the return operation controller in the fourth exemplary embodiment.

FIG. 10A is a flowchart illustrating emergency stop control performed by the emergency stop controller in the fourth exemplary embodiment. FIG. 10B is a flowchart illustrating return operation control performed by the return operation controller in the fourth exemplary embodiment.

The image forming unit 10 illustrated in FIG. 9 is different from that in FIG. 2 in the point that the developing unit 14 is freely movable in arrow X-Y directions for being brought into contact or out of contact with the image holding body 11. In a normal operating state, the developing unit 14 is moved in the arrow Y direction and is placed at a position at which the developing roller 141 faces the image holding body 11.

Like the above-mentioned third exemplary embodiment, the fourth exemplary embodiment is an exemplary embodiment characterized in emergency stop control (FIG. 10A) performed by the emergency stop controller.

When an emergency occurs, at first, under control of the emergency stop controller 41, the developing unit 14 is moved in the arrow X direction to be separated from the image holding body 11 (step S401 in FIG. 10A), and then an emergency stop is done (step S402). When the developing unit 14 is separated from the image holding body 11, the developing roller 141 is also separated from the image holding body 11. Even if an impact upon the emergency stop is applied thereafter, the carrier C is suppressed from flying to the image holding body 11.

After the emergency stop, when the cause of the emergency stop is removed, a return operation is executed next under control of the return operation controller 42 (FIG. 10B). In this return operation, at first, the developing unit 14 is moved in the arrow Y direction up to a fixed position for the developing operation (step S411). Thereafter, the operation is started (step S412); a timer for measuring time until the operation is stopped is switched on (step S413); and, when the timer times out (step S414), the operation in the clean-up step is stopped (step S415).

Although it is described here that the whole developing unit 14 is moved toward and away from the image holding body 11, instead of the whole developing unit 14, only the developing roller 141 may be configured to be moved toward and away from the image holding body 11.

Although the first to fourth exemplary embodiments are separately described here, these exemplary embodiments may be combined and implemented.

Although the so-called tandem-type color printer illustrated in FIG. 1 is described by way of example here, the present technology is applicable to, for example, a monochrome printer in which there is only one image forming unit 10 and there is no intermediate transfer unit 30.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding body that rotates;

an image forming unit including:

a charger that charges the image holding body with electricity;

an exposure unit that exposes the image holding body to light to form an electrostatic latent image;

a developing unit that includes a developing roller that feeds, while rotating, a developer including toner and a carrier to a developing area that faces the image holding body, the developing unit developing the electrostatic latent image with the toner and causing the image holding body to hold a toner image;

a transfer unit that transfers, while pressing a transfer-receiving body against the image holding body, the toner image on the image holding body to the transfer-receiving body; and a cleaning unit that cleans the image holding body, wherein the charger, the exposure unit, the developing unit, the transfer unit, and the cleaning unit sequentially operate along a rotating direction of the image holding body; and a return operation controller that causes a clean-up step to be executed in which the image holding body is cleaned while rotating the image holding body when returning from an emergency stop, wherein, in the clean-up step, the return operation controller reduces a pressing force between the transfer unit and the image holding body, while having the transfer unit in contact with the image holding body, at least until a developing operation area on a surface of the image holding body that is stopped upon the emergency stop facing toward a direction in which the developing unit operates passes through a pressing area pressed by the transfer unit.

2. The image forming apparatus according to claim 1, wherein:

the image holding body comprises a plurality of image holding bodies, and the image forming unit comprises a plurality of image forming units, a subset of a plurality of the transfer units is a transfer unit(s) whose pressing force for the image holding body is unchangeable, and the return operation controller reduces a pressing force between one or more transfer units other than the subset of the plurality of transfer units and one or more image holding bodies in the clean-up step.

3. An image forming apparatus comprising:

an image holding body that rotates;

an image forming unit including:

a charger that charges the image holding body with electricity;

an exposure unit that exposes the image holding body to light to form an electrostatic latent image;

a developing unit that includes a developing roller that feeds, while rotating, a developer including toner and a carrier to a developing area that faces the image holding body, the developing unit developing the electrostatic latent image with the toner and causing the image holding body to hold a toner image;

a transfer unit that transfers, while pressing a transfer-receiving body against the image holding body, the toner image on the image holding body to the transfer-receiving body; and a cleaning unit that cleans the image holding body, wherein the charger, the exposure unit, the developing unit, the transfer unit, and the cleaning unit sequentially operate along a rotating direction of the image holding body; and a return operation controller that causes a clean-up step to be executed in which the image holding body is cleaned while rotating the image holding body when returning from an emergency stop, wherein, in the clean-up step, the return operation controller reduces a pressing force between the transfer unit and the image holding body, while having the transfer unit in contact with the image holding body, at least until an area on a surface of the image holding body to which the developer adheres upon the emergency stop passes through a pressing area pressed by the transfer unit.

4. The image forming apparatus according to claim 3, wherein:

the image holding body comprises a plurality of image holding bodies, and the image forming unit comprises a plurality of image forming units, a subset of a plurality of the transfer units is a transfer unit(s) whose pressing force for the image holding body is unchangeable, and the return operation controller reduces a pressing force between one or more transfer units other than the subset of the plurality of transfer units and one or more image holding bodies in the clean-up step.

* * * * *